US005657941A

United States Patent [19]

Simons et al.

[11] Patent Number: 5,657,941

[45] Date of Patent: Aug. 19, 1997

[54] WEB TENSIONING DEVICE

[75] Inventors: Robert Simons, Newton Falls; Russell Parish, Campbell, both of Ohio

[73] Assignee: Liberty Industries, Inc., Girard, Ohio

[21] Appl. No.: 558,750

[22] Filed: Nov. 20, 1995

Related U.S. Application Data

[63] Continuation-in-part of Ser. No. 91,319, Jul. 14, 1993.

[51] Int. Cl.[6] ..... B65H 23/06

[52] U.S. Cl. ..... 242/420.6

[58] Field of Search ..... 242/420.6, 413.5, 242/421.7

[56] References Cited

U.S. PATENT DOCUMENTS

| | | | |
|---|---|---|---|
| 3,031,152 | 4/1962 | Cohen et al. | 242/413.5 X |
| 3,241,785 | 3/1966 | Barrett . | |
| 3,318,544 | 5/1967 | Jones et al. | 242/420.5 X |
| 3,713,009 | 1/1973 | Poppinger et al. | 242/413.5 X |
| 3,811,637 | 5/1974 | Abler | 242/421.7 |
| 4,146,190 | 3/1979 | Bond et al. . | |
| 4,407,331 | 10/1983 | Rehling et al. | 242/420.6 |
| 4,566,646 | 1/1986 | Benjamin | 242/413.5 |
| 4,696,439 | 9/1987 | Sukigara et al. . | |
| 4,708,301 | 11/1987 | Kataoka | 242/413.5 |
| 4,775,086 | 10/1988 | Kataoka . | |
| 4,838,498 | 6/1989 | Huth . | |
| 4,993,660 | 2/1991 | Harigaya et al. . | |
| 5,277,373 | 1/1994 | Morton | 242/413.5 |

*Primary Examiner*—Daniel P. Stodola
*Assistant Examiner*—Eileen A. Dunn
*Attorney, Agent, or Firm*—Davis Chin; Donald J. Breh; Thomas W. Buckman

[57] ABSTRACT

A web tensioning device to maintain a pre-selected web tension during web delivery and web roller take-up. The device comprises a web pressure sensing roller, tension pre-selection and conditioning circuitry associated therewith. A motor controller responsive to condition circuitry input selectively controlling a supply roller in a closed loop self-regulating system to maintaining desired film tension despite input roller variations.

5 Claims, 4 Drawing Sheets

WEB TENSIONING DEVICE

This is a CIP of Ser. No. 08/091,319, filed Jul. 14, 1993.

BACKGROUND OF THE INVENTION

1. Technical Field

A variety of different web tensioning control devices have been developed to control the web tensioning of material during production and use. Given variations in material yield, it is necessary to maintain an even tension on the web for a constant end product or application.

2. Description of Prior Art

Prior art devices of this type have relied on a variety of different structures to sense and control web tension dependent on the industry and end use and production, see for example U.S. Pat. Nos. 4,146,190, 3,241,785, 4,407,331, 4,696,439, 4,775,086, 4,838,498, 4,993,660.

In U.S. Pat. No. 3,241,785 an apparatus and process for winding under varying tension is disclosed in which the actual tension of the web is sensed by hydraulic means and pneumatic feedback means are used to develop correcting signals that is sent to the final control element.

In U.S. Pat. No. 4,146,190 a web winding control system can be seen having a variable torque output motor controlled by a spring biased dancer roller. The dancer roller pivots on a swinging arm with the relative movement of the roller denoting variations in web tension which accordingly controls output of a control motor transporter.

In U.S. Pat. No. 4,407,331 is directed towards a speed regulator for the warp beam of a weaving machine. The device uses two optical incoders to determine the speed of the web or fiber entering and leaving the tensioning ruler. The tension is induced by the pull of a spring with the tension determined by a combination of a signal from the speed of the incoders and the position of the potentiometer.

In U.S. Pat. No. 4,696,439 a tape speed and tension control system for a magnetic cassette apparatus is disclosed in which a tape speed signal is generated by a speed sensor driven by the speed sensing ruler, a closed loop servomechanism controls a pair of drive motors coupled directly to respective cassette hubs to regulate and maintain constant tape speed.

In U.S. Pat. No. 4,775,086 a take-out/take-up tension control apparatus is disclosed for use in stretched film or sheet production line. The device uses a dancer roller which is used to control the force applied thereto so that accurate tension can be read and maintained. When correction of tension is required, selective forces apply to the dancer roller by displacing same absorbing tension variation.

U.S. Pat. No. 4,838,498 is directed to a web tensioning system using a dancer roller that pivots circumferentially in response to tension changes. A hydraulic control cylinder interconnected to said roller arms imparts relative position implying control values to motorized regulator.

In U.S. Pat. No. 4,993,660 a reel drive device is disclosed utilizing a detector for detecting a rotating state of a reel, data for control holding device for holding data for control of the rotational drive and an output control circuit for causing the data for control holding device to output the data for control of the rotational drive in response to the rotational state of a reel detection in the detector and a drive control circuit for controlling the drive state of the rotational drive in response of the data for control of the rotational drive.

Additionally, tension control devices are known in the art as is evidenced by the publication "New "2000" Series Tension Control For Filament Winding".

This publication describes a tension control system for fibers utilizing full digital control for analysis interpretation of the tension monitor used in association with a network management system, a PC computer and computerized digital control instructions for accurately determining the tension on a filament by a software control.

Such digital tension control devices are complicated, expensive and are primarily used with multiple computer controlled fiber winding and unwinding systems used in a variety of processes and applications in industry.

SUMMARY OF THE INVENTION

A web tensioning device utilizes comparative pressure transducers to optimize and calculate fluctuations in web tension. Pre-selected tension signal input and conditioning circuitry isolates control signal output from pressure transducer inputting same to a motor controller that regulates motor speed and thus effective pressure on the film web which is monitored by the pressure transducers in a close loop regulation system.

DESCRIPTION OF THE PREFERRED EMBODIMENT

The present invention relates to web tensioning control systems to regulate fluctuations in web tension and adjust controlling factors to compensate for same maintaining the web tension in a pre-selected value or range. Such a web tension control system is applicable to a wide variety of applications that require a given web tension during manufacture and use, such as power pre-stretch film dispensing mechanism and the like.

Figure 1:
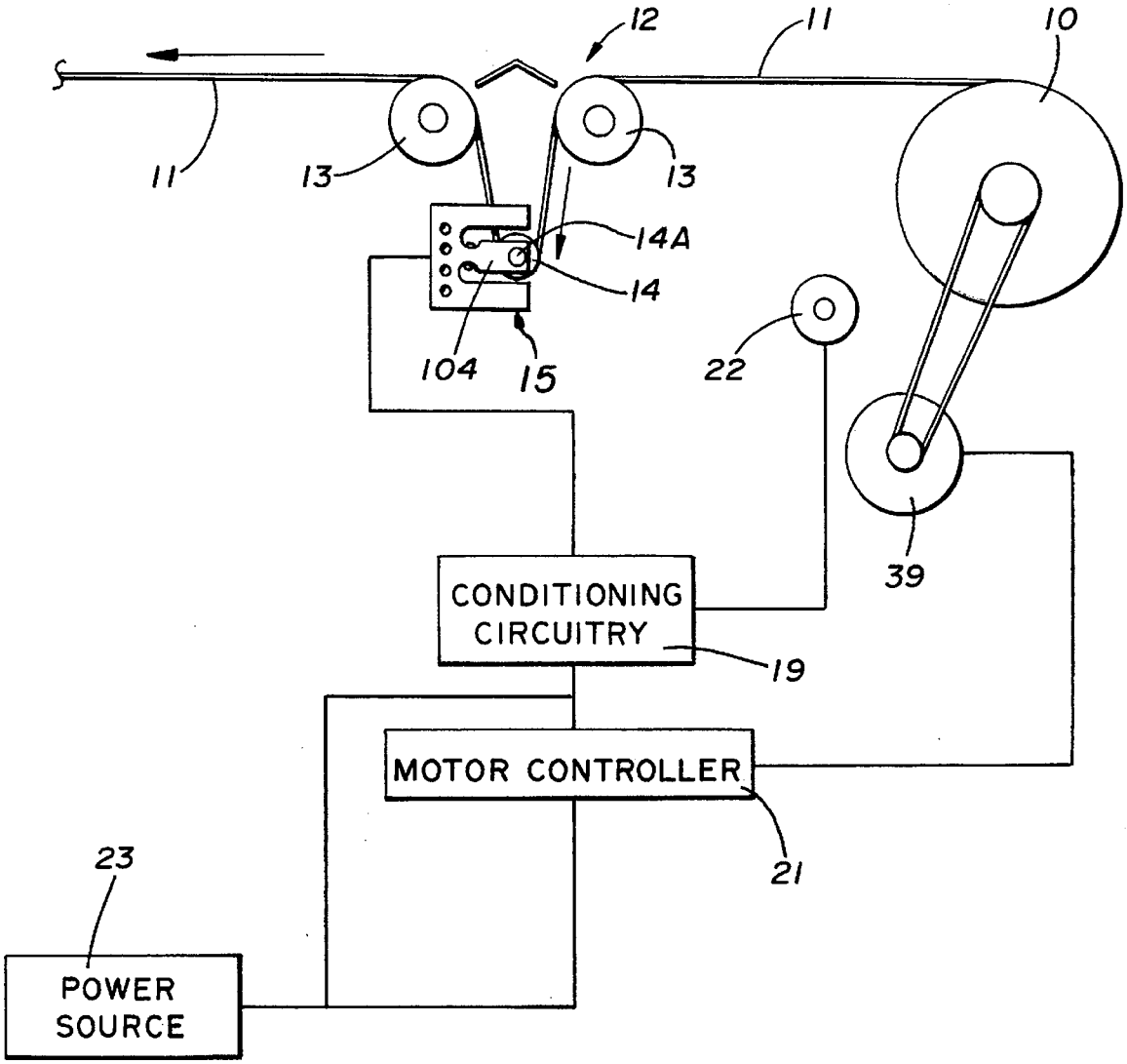
FIG. 1 is a schematic block illustration of the main components in the web tension control system.

Referring now to FIG. 1 of the drawings, a schematic block diagram illustrating the invention, a payoff roll 10 can be seen with a typical film web 11 extending therefrom. The film web 11 is directed through a multiple roller assembly 12 downstream of the payoff roll 10. The film web 11 is pulled under tension in the downstream direction as indicated by the arrows in FIG. 1 of the drawings.

The roller assembly 12 is comprised of a pair of idler rollers 13 and an offset sensing roller 14 from which is detected the effective tension i.e. pressure on the film web.

Figure 2:
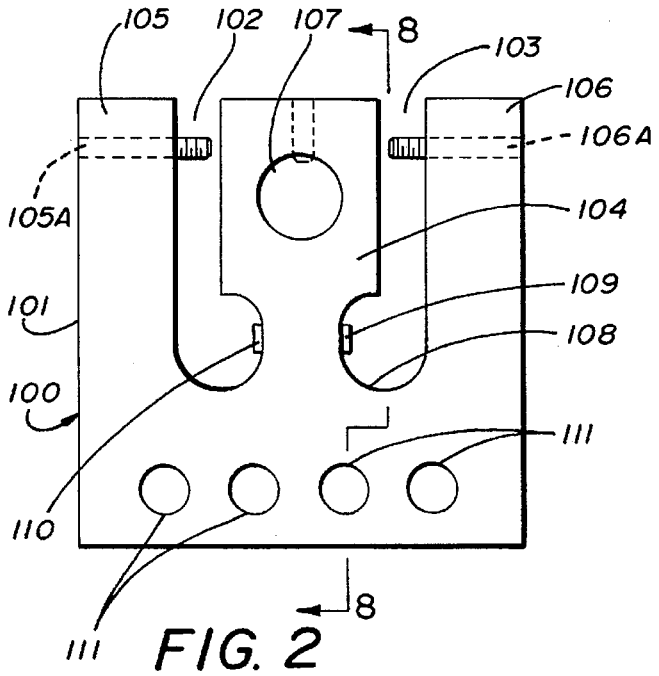
FIG. 2 is a top plan view of a load beam of a pressure transducer.
Figure 3:
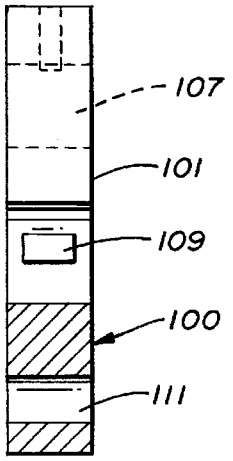
FIG. 3 is a side plan view of the load beam shown in FIG. 2 of the drawings.

The sensing roller 14 has a pressure transducer 15 attached to oppositely disposed ends which transducers together generate a summation of the effective pressure across all points of the sensing roller 14. Because of this arrangement of pressure transducers, it is not necessary that pressure be balanced across the sensor roller 14. Referring to FIGS. 2 and 3 of the drawing, the pressure transducers 15 in this application is comprised of a generally flat square based configuration 101 that is notched inwardly at 102 and 103 defining an elongated load beam 104 therebetween. The remaining portions 105 and 106 of the base configuration 101 on opposite sides of said load beam 104 act as spaced parallel supports for the load beam 104. Each of said support portions 105 and 106 are apertured for adjustable registration of respective set screws 105A and 106A that extend outwardly therefrom into the respective notched areas 102 and 103. The set screws 105A and 106A limit lateral deflection of the center load beam 104 therebetween which is integral with said base configuration 101.

The load beam 104 is apertured at 107 for acceptance of a roller shaft 14A, see FIG. 1 of the drawings that supports the sensing roller 14 hereinbefore described. A set screw 104A is positioned within the end of the load beam 104 for engagement with said roller shaft 14A.

The load beam 104 has an area of reduced transverse dimension at 108 which determines the overall sensitivity of the beam i.e. the narrower the area of reduced dimension as an example one-eighth inch thick area of transverse dimension would equal 0–150 pounds.

A pair of oppositely disposed encapsulated secondary strain gauges 109 and 110 are secured to the respective areas of the load beam defining said area of reduced transverse dimension. The strain gauges 109 and 110 are for detecting the directional deflection of the load beam 104 imparted thereto by the roller shaft 14A of the sensor roller 14 as hereinbefore described.

Multiple apertures 111 within the base configuration 101 for securing the load beam.

The strain gauges 109 & 110 are wired in a "D.C. Wheatstone Bridge" configuration with a signal generated by said strain gauges being sent to a conditioning circuit 19 that buffers, filters and amplifies the signal.

Figure 4:
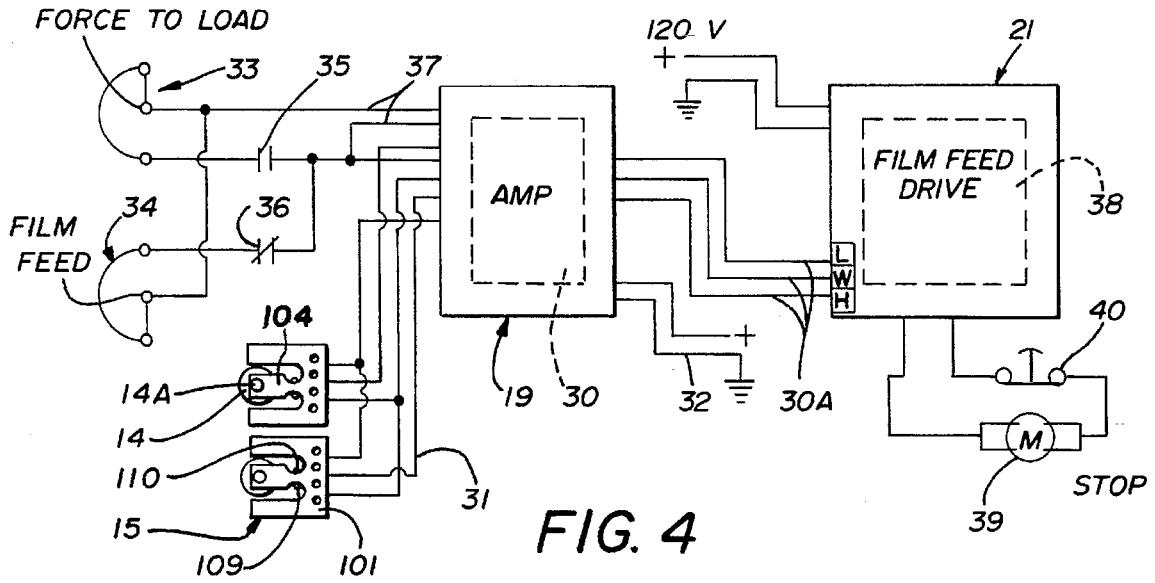
FIG. 4 is a combined block and schematic electrical diagram of the web tensioning control system.

Referring to FIG. 4 of the drawings, a combined schematic and block diagram of the web tensioning device is shown wherein the load beam 104 with attached strain gauges 109 & 110 are interconnected to a four stage linear DC amplifier board 30 via connecting wires 31, having a power supply input at 32. A force to load potentiometer 33 and film feed potentiometer 34 are selectively interconnected to the DC amplifier board 30 via respective relay coils 35, 36 and connecting wires 37. The force to load potentiometer 33 is adjustable for film tension by the user. The DC amplifier board 30 outputs to a motor controller 21 via connecting wires 30A having a film feed drive circuit board 38 which is commonly available (off the shelf) from suppliers such as Dart Manufacturing Company. The film feed drive circuit board 38 outputs to a control motor 39. An on/off motor switch 40 is interconnected between the motor controller 21 and control motor 39 as will be well known and understood by those skilled in the art.

Figures 5, 6:
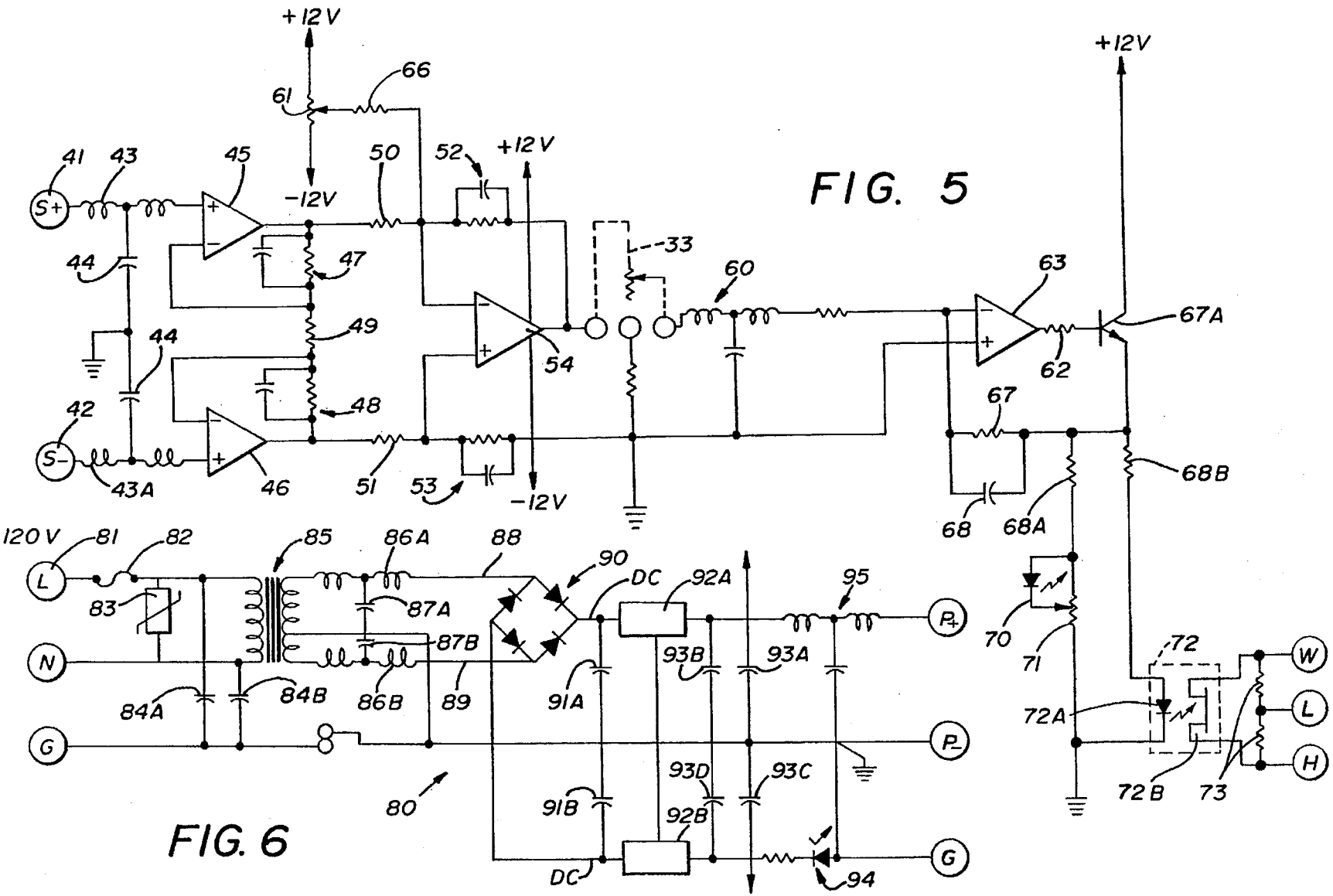
FIG. 5 is an electrical schematic of a portion of the control system illustrating amplifier and control circuits.
FIG. 6 is an electrical schematic of a portion of the control system illustrating DC power supply circuit.

Referring now to FIGS. 5 and 6 of the drawings, the conditioning circuit 19 i.e. (D.C. amplifier board 30) is illustrated wherein the output signal of the strain gauges 109 and 110 are illustrated as input signals S+ and S− at 41 and 42 respectively. Coils 43 and 43A and interconnecting capacitor 44 act as a low pass filter to a first stage amplifier consisting of two operational amplifiers 45 and 46 (available as chip part MC34307A) that perform the initial buffering, amplification and filtering of the input signals S+ and S− 41 and 42 from the hereinbefore described strain gauges 109 and 110 on respective load beams 104.

The output signal of the respective operational amps 45 and 46 pass through respective (and identical) resistor and capacitor filter assemblies 47 and 48 that establish the gain of the amplifiers with the addition of an interconnected resistor 49 requires to establish a ratio therebetween as is well known to those skilled in the art.

The signal is then passed through respective resistors 50 and 51 that act as a link to a secondary resistor and capacitor assemblies 52 and 53 to establish the gain of the amplifiers of stage one.

A pair of resistors 61 and 66 are positioned in front of a second stage amplifier 54 to address possible errors in bridge circuit connect to S− and S+ thus providing a greater tolerance for improved transducer life.

The second stage of amplification receives the first stage output with the second stage consisting of the differential amplifier 54 to provide further amplification and filtering along with the algebraic sum of the signals from stage, one amplifiers. The output of the differential amp 54 is fed to the external potentiometer 33 as hereinbefore described and seen in FIG. 4 of the drawings. The external potentiometer 33 provides a control for the amount of signal applied to a third amplifier stage. Specifically, the output signal from the external potentiometer is directed through a coil and capacitor combination 60 that acts as a low pass filter.

A potentiometer provides a sensitivity adjustment as will be well known to those skilled in the art. Resistor 67 and capacitor 68 establish a ratio gain relationship for a third stage amplifier 63 whose output signal passes through a current limiting resistor 62 to a fourth stage transistor 67A that responds to signal output determining current flow proportionally therethrough to limiting resistors 68A and 68B.

An LED 70 is provided after the limiting resistor 68A to show indication of relative force in an (on) condition or alternately no force in an (off) condition. A potentiometer 71 acts as a sensitivity adjustment for the hereinbefore described LED 70.

An optical isolation chip 72 is indicated in dotted lines utilizes output diode 72A and a reception transistor (FET) 72B to form an isolated transmitted optical connection to the film feed board 38 with the motor controller 21 via output terminals W,L, and H.

This parallel arrangement to the LED circuit and opto-isolator circuit reduces reactivity to the circuit which occurs when adjustments to the potentionmeter 71 are made so that proper correlation between the output of the opto-isolator 72 and LED 70 can be achieved.

Resistors 73 are positioned between the respective terminals W,L, and L and H to provide biasing for the transistor 72B.

The third stage amplification provides means of adjusting the total sensitivity along with the appropriate amount of gain for the fourth stage transistor 67A that acts as a variable resistance to the film feed drive board 38.

Optical isolation is provided between the fourth stage amplification and the output to the film feed board 38 by the isolation stage five. The speed of the DC motor 39 is directly proportional to the variable resistance provided at terminals L and W. The terminal H received +12 volts potential from DC film feed board.

The four stage linear DC amplifier board 30 is supplied by a DC power supply circuit 80, best seen in FIG. 6 of the drawings. The DC power supply circuit 80 is within the conditioning circuit 19.

Line voltage i.e. (120 volts VAC) is supplied to terminal L at 81 with respective terminals N (neutral) and G (ground) adjacent thereto.

A fuse 82 and surge protector 83 are provided as well as a pair of capacitors 84 A and 84 B acting as high pass filters for incoming voltage. A center tap step down transformer 85 drops the voltage from 120 VAC to 35 volts for a low pass filter assembly of identical coils 86A and 86B and associated capacitors 87A and 86B providing one-half 35 volt output to line 88 and one-half 35 volt output to line 89 respectively.

A full wave bridge rectifier 90 and related capacitors 91A and B converts AC current to a flat DC voltage output.

Voltage regulators 92A and 92B lock in +12, −12 volts to a group of capacitors 93A, 93B, 93C, 93D that filter and clean up the DC signal. An LED and resistor combination 94 indicates state of board as either being on or off.

A coil and capacitor combination 95 acts as a second low pass filter with respective power output of 12 volt (±) available at terminals P+ and P− with a ground terminal G (ground). The DC power supply circuit also provides power to the respective strain gauges hereinbefore described.

Referring to FIGS. 7–10 of the drawings, alternate film web angular feed configurations are shown that provide a range of film web angles between the pay-off roll 10, the load beam 100 and sensing roll assembly downstream therefrom. The computations of configurations require selected performance value for the load beam 104 which is dependent on beam width at strain gauge position and drive motor capacity.

An example of same would be given a drive motor of 0–90 volts with a 100% capacity and a load beam configured for 0–100 pound response range. Given same, FIG. 1 thus illustrates full motor capacity 100% with a given 100 pound response of the load beam 100.

Figure 7:
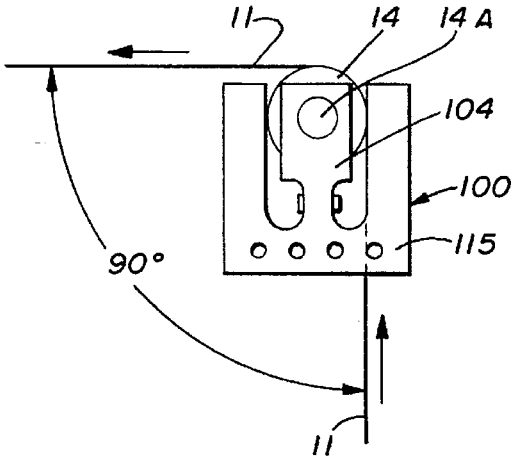
FIG. 7 is a partial schematic illustrating film feed direction option through the load beam configuration.

FIG. 7 shows film at 90 degrees angular inclination which gives 50% motor capacity with 200 pound load beam response.

Figure 8:
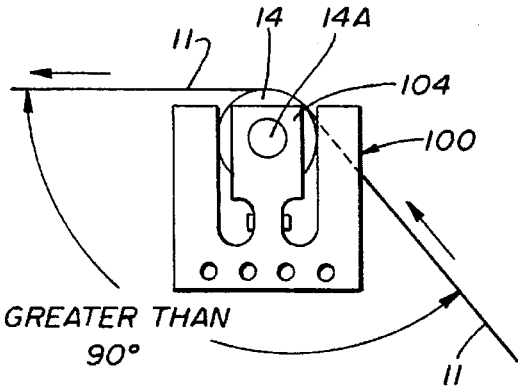
FIG. 8 is a partial schematic illustrating film feed direction of greater than 90 degrees through the load beam configuration.

FIG. 8 shows film at greater than 90 degrees angular inclination which gives a 30% motor capacity with 250 pounds of load beam response.

Figure 9:
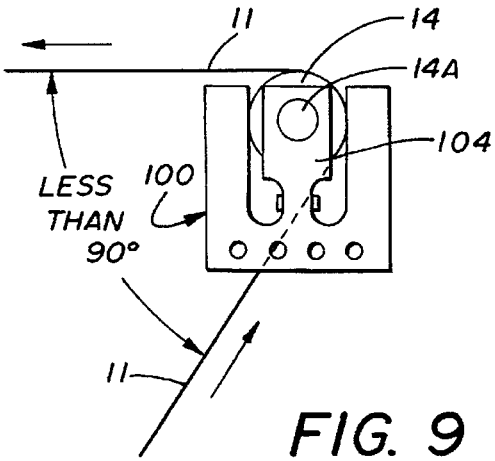
FIG. 9 is a partial schematic illustrating film feed direction of less than 90 degrees through the load beam configuration.

FIG. 9 shows the film at less than 90 degrees angular inclination which thus gives a 75% motor capacity with 175 pound load beam response.

Figure 10:
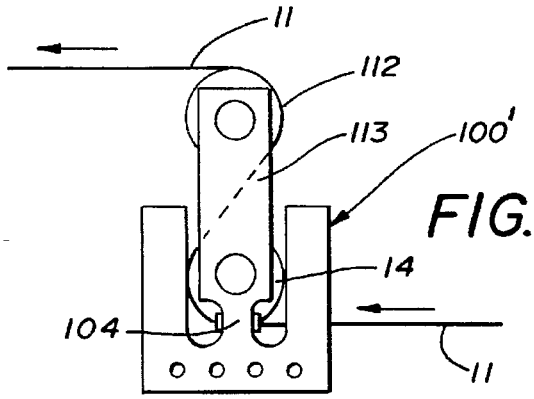
FIG. 10 is a partial schematic illustrating film feed direction of 90 degrees through the load beam configuration.

In FIG. 10 a yet further modification of a load beam configuration is shown in which two spaced sensor rolls 14 and 112 are positioned within a support bracket 113 which in this example would give 90% of motor capacity with one and a half times the response to the load beam or 150 pound load beam response.

In operation, the pay-off roll 10 is controlled by the interconnected control motor 39 by variations in the control motor 39 speeds with the film web tension T being changed in response to the tension i.e. pressure variations caused by the relative applications or inputs on the film web.

The motor controller 21 and its film feed drive board 38 are directly connected to the control motor 39 and is responsive to control inputs from the hereinbefore described conditioning circuit 19.

In this schematic example, a pre-selected web tensioning setting is selected by the external potentiometer 33 and inputted directly into the conditioning circuit 19 as hereinbefore described. An external power source 23 supplies the DC power supply circuit 80 and also supplies the motor 20 through the motor controller 21.

Thus, in operation the motor 39 speeds up or slows down in response to the control signal generated by the conditioning circuit 19 and accordingly the speed change of the motor 39 affects the relative pressure sensed in the film web 11 as indicated by pressure changes on the sensing roller 14 and associated pressure transducers 15 which are configured by the load beam and associated strain gauges 109 and 110.

This combination forms a closed loop system that becomes self-regulating to maintain a desired pre-selected film web tension regardless of the inevitable variations in film web tension as produced by demand on film web 11 during operation.

By use of the hereinbefore described invention a dramatic improvement in web tensioning control device has been achieved. This invention allows for more consistent control of film web 11 and associated tension than was heretofore possible applying film in use applications at lower force than was possible before.

The various angular configurations of the film web in relation to the sensing roller 14 and associated alternate load beam 100 provides a variety of different load beam and motor capacity which was heretofore unavailable.

It will thus be seen that a new and useful film web tensioning device has been illustrated and described and it will be apparent to those skilled in the art that various changes and modifications may be made therein without departing from the spirit of the invention, therefore

I claim:

1. A self-adjusting closed loop tensioning system for controlling tension in a film web from a pay-off supply roll comprising in combination;

a drive motor interconnected to said pay-off supply roll;

a motor controller connected to said drive motor;

a sensor roller disposed downstream of said pay-off supply roll;

said film web extending from said pay-off supply roll through said sensor roller;

a pair of pressure transducers secured to opposite ends of said sensor roller and being responsive to the tension in the film web for generating first and second output signals;

a first conditioning circuit being responsive to said first and second output signals for producing a control signal;

said motor controller being responsive to said control signal for varying the speed of said drive motor to maintain a preset tension on said film web;

each of said pressure transducers including a U-shaped member; and said U-shaped member being formed of a base, a pair of spaced-apart support portions integrally joined with said base, a load beam disposed between said pair of spaced apart support portions so as to define a pair of opposing notched areas therebetween, said load beam having an area of reduced transverse dimension defined by said pair of opposing notched areas, a pair of strain gauges each secured to opposite sides of said load beam adjacent said area of reduced transverse dimension, means for limiting lateral deflection of said load beam, and means for securing said base independent of said load beam.

2. A self-adjusting closed loop as claimed in claim 1, wherein said conditioning circuit comprises a multiple stage amplifier circuit configuration having an output, a control input from an external potentiometer and means for isolating said output of said amplifier circuit configuration from said motor controller.

3. A self-adjusting closed loop as claimed in claim 1, wherein said load beam has an aperture formed inwardly of the free end thereof and further comprising means for engaging said sensor roller with said aperture in said load beam.

4. A self-adjusting closed loop as claimed in claim 1, wherein said means for limiting lateral deflection of said load beam comprises oppositely disposed adjustable set screw elements extending from said support portions into said opposing notched areas.

5. A self-adjusting closed loop as claimed in claim 1, wherein said means for securing said base comprises a plurality of longitudinally aligned spaced apertures therein adapted to receive fastener means for joining said base to another support member.

* * * * *